US005575958A

United States Patent [19]

Jöllenbeck et al.

[11] Patent Number: 5,575,958

[45] Date of Patent: Nov. 19, 1996

[54] AQUEOUS DISPERSIONS OF SPARINGLY SOLUBLE UV ABSORBERS

[75] Inventors: Martin Jöllenbeck, Freiburg, Germany; Josef Zelger, Riehen, Switzerland

[73] Assignee: Ciba-Geigy Corporation, Tarrytown, N.Y.

[21] Appl. No.: 292,159

[22] Filed: Aug. 17, 1994

Related U.S. Application Data

[63] Continuation of Ser. No. 210,976, Mar. 21, 1994, abandoned, which is a continuation of Ser. No. 732,990, Jul. 19, 1991, abandoned.

[30] Foreign Application Priority Data

Jul. 23, 1990 [CH] Switzerland ..... 2430/90

[51] Int. Cl.[6] ..... F21V 9/04; C09B 67/00; D06P 5/02

[52] U.S. Cl. ..... 252/589; 8/566; 8/442

[58] Field of Search ..... 252/582, 589; 8/566, 442

[56] References Cited

U.S. PATENT DOCUMENTS

| | | | |
|---|---|---|---|
| 4,386,037 | 5/1983 | Baumann | 8/589 |
| 4,557,730 | 12/1985 | Bennett et al. | 8/442 |
| 4,831,068 | 5/1989 | Reinert et al. | 8/442 |
| 4,895,981 | 1/1990 | Reinert et al. | 252/589 |
| 5,009,669 | 4/1991 | Jollenbeck et al. | 8/573 |

*Primary Examiner*—Philip Tucker
*Attorney, Agent, or Firm*—Kevin T. Mansfield

[57] ABSTRACT

Aqueous dispersions of UV absorbing s-triazine compounds comprising (a) 5 to 50 percent by weight of an s-triazine compound of formula

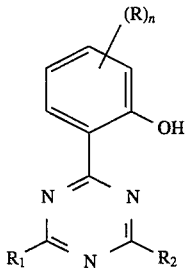

(1)

wherein R, $R_1$, $R_2$ and n are as defined in claim 1, and (b) 0 to 18 percent by weight of an anionic compound, and (c) 0 to 18 percent by weight of a nonionic compound, with the proviso that at least one of components (b) and (c) must be present.

These dispersions are excellent formulations for enhancing the lightfastness of dyeings on synthetic fibers, especially on polyester or acid-modified polyester fibers.

4 Claims, No Drawings

AQUEOUS DISPERSIONS OF SPARINGLY SOLUBLE UV ABSORBERS

This application is a continuation of application Ser. No. 08/210,976, filed Mar. 21, 1994, abandoned, which is a continuation of Ser. No. 07/732,990 filed Jul. 19, 1991, abandoned.

The present invention relates to an aqueous dispersion of sparingly soluble UV absorbers and to the use thereof for dyeing synthetic fibres, especially polyester fibres or acid-modified polyester fibres.

The aqueous dispersion of this invention comprises (a) 5 to 50 percent by weight of an s-triazine compound of formula

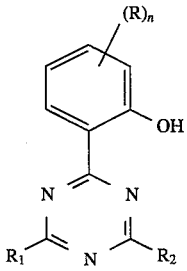

(1)

wherein

R is lower alkyl, lower alkoxy, halogen or hydroxy, $R_1$ and $R_2$ are each independently of the other $C_1$–$C_{18}$alkyl, $C_1$–$C_{18}$alkyl which is substituted by hydroxy, lower alkoxy, lower alkylthio, amino or mono- or dialkylamino, phenyl or phenyl which is substituted by chloro, hydroxy, lower alkyl and/or lower alkoxy, and n is 0, 1 or 2, (b) 0 to 18 percent by weight of an anionic compound, and (c) 0 to 18 percent by weight of a nonionic compound, with the proviso that at least one of components (b) and (c) must be present.

The aqueous dispersion of this invention conveniently contains 10 to 45 percent by weight of component (a), 0.5 to 15 percent by weight of component (b), and 0.5 to 15 percent by weight of component (c). Component (a) preferably has a particle size of less than 5 μm.

Component (a) as well as components (b) and (c) may be in the form of individual compounds or as a mixture.

An alkyl group $R_1$ and $R_2$ may be straight-chain or branched. Such alkyl groups will typically be methyl, ethyl, n-propyl, isopropyl, n-butyl, isobutyl, sec-butyl, tert-butyl, amyl, isoamyl, tert-amyl, n-hexyl, 2-ethylhexyl, n-heptyl, n-octyl, isooctyl, n-nonyl, isononyl, n-dodecyl, heptadecyl or octadecyl.

R, $R_1$ and $R_2$ as lower alkyl, alkoxy or alkylthio are groups containing 1 to 4 carbon atoms and are typically methyl, ethyl, propyl, isopropyl, butyl, isobutyl, sec-butyl, tert-butyl, methoxy, ethoxy, propoxy, isopropoxy, butoxy, isobutoxy, sec-butoxy, tert-butoxy, methylthio, ethylthio, propylthio, isopropylthio, butylthio, isobutylthio, sec-butylthio or tert-butylthio.

Halogen is typically fluoro, bromo or, preferably, chloro.

Important components (a) have the formula

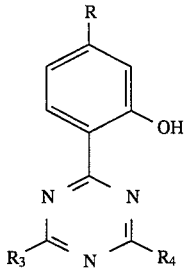

(2)

wherein

R is as defined above, and $R_3$ and $R_4$ are each independently of the other alkyl of 1 to 4 carbon atoms, phenyl or phenyl which is substituted by lower alkyl and/or lower alkoxy, and preferably the formula

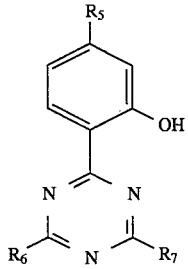

(3)

wherein $R_5$ is lower alkyl or lower alkoxy, and $R_6$ and $R_7$ are each independently of the other alkyl of 1 to 4 carbon atoms or phenyl.

Compounds of formula (1), wherein R is lower alkoxy and $R_1$ and $R_2$ are each phenyl, are especially preferred.

The compounds of formulae (1), (2) and (3), which are also known as UV absorbers, are known or can be prepared in a manner which is known per se, conveniently by heating an amidine and a o-hydroxybenzenecarboxylate, preferably in the molar ratio of 2:1, in a boiling organic solvent [cf. U.S. Pat. No. 3,896,125 and Helv. Chim. Acta 55, 1566–1595 (1972)].

Illustrative examples of suitable compounds of formulae (1), (2) and (3) are:

2-(2'-hydroxy-5'-methylphenyl)-4,6-dimethyl-s-triazine; m.p. 131° C.:

2-(2'-hydroxy-3',5'-dimethylphenyl)-4,6-dimethyl-s-triazine: m.p. 177° C.:

2-(2'-hydroxy-4',5'-dimethylphenyl)-4,6-dimethyl-s-triazine: λ 349 μm: T 48%:

2-(2'-hydroxy-4',5'-dimethylphenyl)-4,6-diethyl-s-triazine: m.p. 98° C.:

2-(2'-hydroxy-5'-chlorophenyl)-4,6-dimethyl-s-triazine: m.p. 160° C.:

2-(2'-hydroxyphenyl)-4,6-dimethyl-s-triazine: m.p. 133° C.:

2-(2'-hydroxy-5'-tert-butylphenyl)-4,6-dimethyl-s-triazine: λ 352 μm: T 60%:

2-(2'-hydroxyphenyl)-4,6-didecyl-s-triazine: m.p. 53° C.:

2-(2'-hydroxyphenyl)-4,6-dinonyl-s-triazine: m.p. 45° C.:

2-(2'-hydroxyphenyl)-4,6-diheptadecyl-s-triazine: λ 338 μm: T 80%:

2-(2'-hydroxyphenyl)-4,6-dipropyl-s-triazine: m.p. 18° to 20° C.:

2-(2'-hydroxyphenyl)-4,6-bis(β-methylmercaptoethyl)-s-triazine: λ 341 μm: T 60%:

2-(2'-hydroxyphenyl)-4,6-bis(β-dimethylaminoethyl)-s-triazine: λ 340 μm: T 63%:

2-(2'-hydroxyphenyl)-4,6-bis-(β-butylaminoethyl)-s-triazine: λ 341 μm: T 66%:

2-(2'-hydroxyphenyl)-4,6-di-tert-butyl-s-triazine: λ 338 μm: T 68%:

2-(2'-hydroxyphenyl)-4,6-dioctyl-s-triazine: m.p. 40° C.:

2-(2'-hydroxy-4'-methoxyphenyl)-4,6-diphenyl-s-triazine: m.p. 204°–205° C.

2-(2'-hydroxy-4'-ethoxyphenyl)-4,6-diphenyl-s-triazine: m.p. 201°–202° C. and 2-(2'-hydroxy-4'-isopropyl)-4,6-diphenyl-s-triazine: m.p. 181°–182° C.

(T being the percent transmittance of a solution of 1 mg compound in 100 ml chloroform at a layer thickness of 1 cm)

Suitable components (b) are compounds selected from the group consisting of (ba) acid esters, or their salts, of alkylene oxide polyadducts of formula

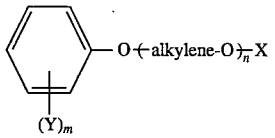

(4)

wherein

X is the acid radical of an inorganic oxygen-containing acid such as sulfuric acid or, preferably, phosphoric acid, or is also the radical of an organic acid, and Y is $C_1$–$C_{12}$alkyl, aryl or aralkyl, "alkylene" is the ethylene or propylene radical, and m is 1 to 4 and n is 4 to 50, (bb) polystyrene sulfonates, (bc) fatty acid taurides, (bd) alkylated diphenyl oxide mono- or disulfonates, (be) sulfonates of polycarboxylates, (bf) polyadducts of 1 to 60 mol, preferably 2 to 30 mol, of ethylene oxide and/or propylene oxide with fatty amines, fatty amides, fatty acids or fatty alcohols, each of 8 to 22 carbon atoms or with trihydric to hexahydric alkanols of 3 to 6 carbon atoms, which polyadducts have been converted into an acid ester with an organic dicarboxylic acid or an organic polybasic acid, (bg) ligninsulfonates, and (bh) formaldehyde condensates.

The acid radical X in formula (4) is conveniently derived from low molecular dicarboxylic acids, typically maleic acid, succinic acid or sulfosuccinic acid, and is linked through an ester bridge to the alkylene oxide part of the molecule. Preferably, however, X is derived from an inorganic polybasic acid such as sulfuric acid or, more particularly, orthophosphoric acid.

The acid radical X may be in the form of the free acid or in salt form, i.e. in the form of an alkali metal salt, alkaline earth metal salt, ammonium salt, amine salt or fatty amine salt. Typical examples of such salts are lithium, sodium, potassium, barium, magnesium, ammonium, trimethylamine, diethylamine, ethanolamine, diethanolamine or triethanolamine salts. Alkali metal salts are preferred, and triethanolamine salts are especially preferred. The mono- and diethanolamine salts as well as amines and fatty amines can be further etherified with 1 to 25 oxyalkylene units.

An alkyl group Y in formula (4) can be straight-chain or branched and is typically methyl, ethyl, n-propyl, isopropyl, n-butyl, isobutyl, sec-butyl, tert-butyl, amyl, isoamyl, tert-amyl, n-hexyl, 2-ethylhexyl, n-heptyl, n-octyl, isooctyl, n-nonyl, isononyl or n-dodecyl.

Y as aralkyl preferably contains altogether 7 to 9 carbon atoms and is typically benzyl, α-methylbenzyl, α,α-dimethylbenzyl, β-phenethyl, α-tolylethyl or phenisopropyl.

Y in formula (4) is preferably $C_4$–$C_{12}$alkyl, benzyl, preferably $C_4$–$C_{10}$alkyl or, most preferably, α-methylbenzyl.

The substituent Y may also have different cited meanings.

n is preferably 6 to 30, and m is preferably 1 to 3.

(Alkylene-O-)$_n$ chains are preferably of the ethylene glycol, propylene ethylene glycol or ethylene propylene glycol type; the first type is preferred.

Preferred acid esters of component (ba) have the formula

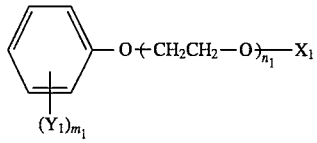

(5)

wherein $Y_1$ is $C_4$–$C_{12}$alkyl, phenyl, tolyl, tolyl-$C_1$–$C_3$alkyl or phenyl-$C_1$–$C_3$alkyl, for example α-methylbenzyl or α,α-dimethylbenzyl, $X_1$is an acid radical which is derived from sulfuric acid or, preferably, o-phosphoric acid, and $m_1$ is 1 to 3 and $n_1$ is 4 to 40.

These acid esters are preferably in the form of sodium, potassium, ammonium, diethylamine, triethylamine, diethanolamine or triethanolamine salts.

The acid esters of formula (4) or (5) suitable for use as component (ba) are prepared by addition of alkylene oxide (ethylene oxide or propylene oxide) to a substituted phenol as defined herein and converting the polyadduct with a polybasic oxyacid or a functional derivative thereof, typically an acid anhydride, acid halide, acid ester or acid amide, into the acid ester and, if desired, converting said acid ester into an aforementioned salt. Illustrative examples of these functional derivatives are phosphorus pentoxide, phosphoroxy trichloride, chlorosulfonic acid or sulfamic acid. The addition of alkylene oxide as well as the esterification can be carried out by known methods.

Very suitable components (ba) are acid esters, or their salts, of a polyadduct of 4 to 40 mol of ethylene oxide with 1 mol of a phenol which contains at least one $C_4$–$C_{12}$alkyl group, a phenyl group, a tolyl group, an α-tolylethyl group, a benzyl group, an α-methylbenzyl group or an α,α-dimethylbenzyl group, typically butylphenol, tributylphenol, octylphenol, nonylphenol, dinonylphenol, o-phenylphenol, benzylphenol, dibenzylphenol, α-tolylethylphenol, dibenzyl(nonyl)phenol, α-methylbenzylphenol, bis(α-methylbenzyl)phenol or tris(α-methylbenzyl)phenol, which acid esters may be used singly or in admixture.

Components (ba) which merit special interest are the phosphate esters of polyadducts of 6 to 30 mol of ethylene oxide with 1 mol of 4-nonylphenol, 1 mol of dinonylphenol or, preferably, with 1 mol of compounds which are prepared by addition of 1 to 3 mol of styrenes to 1 mol of phenols, which phosphate esters are conveniently obtained as mixtures of the corresponding salts of a mono- or diester.

The styrene adducts are prepared in known manner, preferably in the presence of a catalyst such as sulfuric acid, p-toluenesulfonic acid or, most preferably, zinc chloride. Suitable styrenes are preferably styrene, α-methylstyrene or vinyl toluene (4-methylstyrene). The phenols are typically phenol, cresols or xylenols.

The most preferred components (ba) are phosphate esters (mono- and diesters), or their salts, of alkylene oxide polyadducts of formula

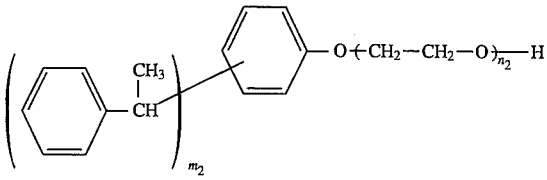

(6)

wherein $m_2$ is 1 to 3 and $n_2$ is 8 to 30, preferably 12 to 20.

Specific examples of alkylene oxide polyadducts of formulae (5) and (6) are:

the polyadduct, containing 18 ethylene oxide units, of ethylene oxide with 2 mol of styrene and 1 mol of phenol, the polyadduct, containing 18 ethylene oxide units, of ethylene oxide with 3 mol of styrene and 1 mol of phenol, the polyadduct, containing 27 ethylene oxide units, of ethylene oxide with 2 mol of 4-methylstyrene and 1 mol of phenol, the polyadduct, containing 17 ethylene oxide units, of ethylene oxide with 3 mol of 4-methylstyrene and 1 mol of phenol, the ethoxylated mixture, containing 18 ethylene oxide units, of the adduct of 2 mol of styrene and 1 mol of phenol and the adduct of 3 mol of styrene with 1 mol of phenol, the ethoxylated mixture, containing 13 ethylene oxide units, of the adduct of 2 mol of styrene and 1 mol of phenol and the adduct of 3 mol of styrene with 1 mol of phenol.

Illustrative examples of the anionic compounds mentioned in (bc) to (bh) are:

as component (bc), suitably compounds of formula (7) $R—CO—NH—CH_2—CH_2—SO_3H$, wherein R is $C_{11}$–$C_{17}$alkyl (cf. for example U.S. Pat. No. 4,219,480)

as component (bd), suitably compounds of formula (8)

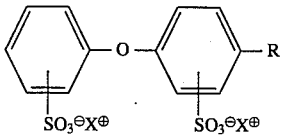

(8)

wherein R is $C_{10}$–$C_{18}$alkyl and X is hydrogen or alkali metal:

as component (be), suitably dihexylsulfosuccinates, bis(2-ethylhexyl)sulfosuccinates, dioctylsulfosuccinates, sulfosuccinamides or compounds of formula

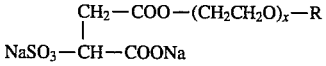

(9)

wherein R is $C_8$–$C_{18}$alkyl or alkylphenol containing 4 to 12 carbon atoms in the alkyl moiety and x is 1 to 10, preferably 2 to 4;

as component (bf), polyadducts of 2 to 30 mol of ethylene oxide with fatty amines, fatty amides, fatty acids or fatty alcohols or trihydric to hexahydric alkanols, which polyadducts have been convened into an acid ester with maleic acid, malonic acid, sulfosuccinic acid and, preferably, o-phosphoric acid or, most preferably, with sulfuric acid;

as component (bh), suitably condensates of ligninsulfonates and/or phenol and formaldehyde, condensates of formaldehyde and aromatic sulfonic acids such as condensates of ditolyl ether sulfonates and formaldehyde, condensates of naphthalenesulfonic acid and/or naphthol- or naphthylaminesulfonic acids with formaldehyde, condensates of phenolsulfonic acids and/or sulfonated dihydroxydiphenylsulfone and phenols or cresols with formaldehyde and/or urea, as well as condensates of diphenyl oxide-disulfonic acid derivatives with formaldehyde.

Preferred condensates suitable for use as component (bh) are the condensates of ditolyl ether sulfonates and formaldehyde described in U.S. Pat. No. 4,386,037, the condensates of phenol and formaldehyde with ligninsulfonates described in U.S. Pat. No. 3,931,072, condensates of 2-naphthol-6-sulfonic acid, cresol, sodium bisulfite and formaldehyde [cf. FIAT-Report 1013 (1946)], and the condensates of diphenyl derivatives and formaldehyde described in U.S. Pat. No. 4,202,838.

The acid radical of the anionic compounds is normally in salt form, i.e. as alkali metal salt, ammonium salt or amine salt. Typical examples of such salts are lithium, sodium, potassium, ammonium, trimethylamine, ethanolamine, diethanolamine or triethanolamine salts.

Suitable for use as component (c) are the compounds which are selected from the group of (ca) alkylene oxide polyadducts of formula

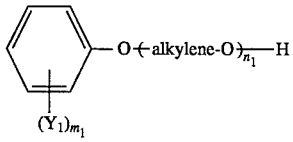

(10)

wherein $Y_1$ is $C_1$–$C_{12}$alkyl, aryl or aralkyl,

"alkylene" denotes the ethylene radical or propylene radical and $m_1$ is 1 to 4 and $n_1$ is 4 to 50, (cb) polyadducts of alkylene oxide with (cba) saturated or unsaturated monohydric to hexahydric aliphatic alcohols, (cbb) fatty acids, (cbc) fatty amines, (cbd) fatty amides, (cbe) diamines, (cbf) sorbitan esters, (cc) alkylene oxide condensates (block polymers), (cd) polymers of vinyl pyrrolidone, vinyl acetate or vinyl alcohol, and (ce) copolymers or terpolymers of vinyl pyrrolidone with vinyl acetate and/or vinyl alcohol.

Preferred dispersions of this invention contain components (b) and (c) in a ratio of (b):(c) of 20:1 to 1:20, preferably 5:1 to 1:5.

Very suitable components (ca) are polyadducts of 4 to 40 mol of ethylene oxide with 1 mol of a phenol which contains at least one $C_4$–$C_{12}$alkyl group, one phenyl group, one tolyl group, one α-tolylethyl group, one benzyl group, one α-methylbenzyl group or one α,α-dimethylbenzyl group, conveniently butylphenol, tributylphenol, octylphenol, nonylphenol, dinonylphenol, o-phenylphenol, benzylphenol, dibenzylphenol, α-tolylethylphenol, dibenzyl(nonyl)phenol, α-methylbenzylphenol, bis(α-methylbenzyl)phenol or tris(α-methylbenzyl)phenol, which adducts may be used singly or in admixture.

Particularly interesting polyadducts suitable for use as component (ca) are polyadducts of 6 to 30 mol of ethylene oxide with 1 mol of 4-nonylphenol, with 1 mol of dinonylphenol or, in particular, with 1 mol of compounds which are prepared by addition of 1 to 3 mol of styrenes with 1 mol of phenols.

The styrene polyadducts are prepared in known manner, preferably in the presence of a catalyst such as sulfuric acid or p-toluenesulfonic acid or, preferably, zinc chloride. Suitable styrenes are preferably styrene, α-methylstyrene or vinyl toluene (4-methylstyrene). The phenols are typically phenol, cresols or xylenols.

Very particularly preferred polyadducts are ethylene oxide polyadducts of formula

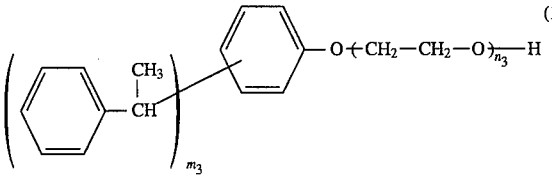

(11)

wherein $m_3$ is 1 to 3 and $n_3$ is 8 to 30.

Such polyadducts are exemplified hereinabove. Also preferred are ethylene oxide polyadducts of formula

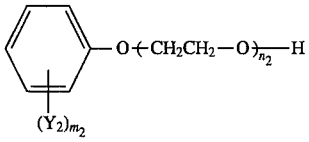

(12)

wherein $Y_2$ is $C_4$–$C_{12}$alkyl, phenyl, tolyl, tolyl-$C_1$–$C_3$alkyl or phenyl-$C_1$–$_3$alkyl, such as α-methyl- or α,α-dimethylbenzyl, and $m_2$ is 1 to 3 and $n_2$ is 4 to 40.

The nonionic component (cb) is conveniently

- a polyadduct of 1 to 100 mol of alkylene oxide, such as ethylene oxide and/or propylene oxide, with 1 mol of an aliphatic monoalcohol containing at least 4 carbon atoms, of a trihydric to hexahydric aliphatic alcohol or of a phenol which may be substituted by alkyl, phenyl, α-tolylethyl, benzyl, α-methylbenzyl or α,α-dimethylbenzyl (cba);
- a polyadduct of 1 to 100 mol, preferably 2 to 80 mol, of ethylene oxide with higher unsaturated or saturated monoalcohols (cba), fatty acids (cbb), fatty amines (cbc) or fatty amides (cbd) of 8 to 22 carbon atoms, individual ethylene oxide units of which polyadduct may be replaced by substituted epoxides such as styrene oxide and/or propylene oxide;
- a polyadduct of alkylene oxide, preferably of ethylene oxide and propylene oxide, with ethylenediamine (cbe);
- an ethoxylated sorbitan ester containing long-chain ester groups, such as polyoxyethylene sorbitan monolaurate containing 4 to 20 ethylene oxide units, or polyoxyethylene sorbitan trioleate containing 4 to 20 ethylene oxide units (cbf).

Preferred components (cc) are ethylene oxide/propylene oxide adducts (EO-PO block polymers) and propylene oxide/polyethylene oxide adducts (reversed EO-PO block polymers).

Particularly preferred EO-PO block polymers are those having molecular weights, based on polypropylene oxide, of 1700 to 4000, and containing 30–80%, preferably 60–80%, of ethylene oxide in the entire molecule.

In addition to components (a), (b) and (c), the dispersion of this invention conveniently also contains as component (d) a stabiliser or thickener.

Component (d) is most suitably a carboxyl group containing polymer. This polymer is added in the form of a 0.5 to 10%, preferably 0.5 to 5%, aqueous solution or dispersion, based on said solution or dispersion.

These polymers are preferably polymerised, ethylenically unsaturated mono- or dicarboxylic acids of 3 to 5 carbon atoms, such as polyacrylic acid or polymers of methacrylic acid, crotonic acid, itaconic acid, teraconic acid, maleic acid or the anhydride thereof, fumaric acid, citraconic acid or mesaconic acid, copolymers of olefins such as ethylene or propylene, diketenes, acrylates, methacrylates or acrylamides and the aforementioned monomers including acrylic acid or copolymers of acrylic acid with methacrylic acid, methacrylonitrile or vinyl monomers, such as vinylphosphonic acid, copolymers of maleic acid and styrene, maleic acid and a vinyl ether or maleic acid and a vinyl ester, such as vinyl acetate or copolymers of vinyl pyrrolidone with vinyl acetate or vinylpropionic acid.

The carboxyl group containing polymers suitable as thickeners can have a molecular weight of 0.5 to 6 million.

Solutions of polyacrylic acid or also copolymers of acrylic acid and acrylamide have been found to be especially useful components (d). The molecular weight of these copolymers varies from 0.5 to 6 million. The molar ratio of acrylic acid:acrylamide in these copolymers is conveniently 1:0.8 to 1:1.2. A partially hydrolysed polymaleic anhydride can also be used as component (d). It is partly in the form of a water-soluble salt and has a molecular weight in the range of preferably 300 to 5000.

Further useful thickeners suitable for use as component (d) are polysaccharides such as carboxymethyl cellulose, methyl cellulose, methyl- or ethylhydroxyethyl cellulose, carob seed gum ether or starch ethers as well as alginates, polyethylene glycols, polyvinylpyrrolidones, polyvinyl alcohols or also finely particulate silicic acid preferably having a specific surface area of 50 to 380 $m^2/g$, and sheet silicates such as bentonites, bentones, smectites and montmorillonites. Also very suitable are anionic heteropolysaccharides which are formed from the monosaccharides, glucose and mannose and glucuronic acid.

The amount of this additional component (d) is normally from 0.05 to 8 percent by weight, preferably from 0.1 to 4 percent by weight, based on the entire aqueous dispersion.

Besides components (a), (b) and (c) or (a), (b), (c) and (d), the aqueous dispersion may additionally contain antifoams, preservatives or antifreeze agents.

The anionic and nonionic compounds may be used alone or combined with each other.

The antifoams present in the dispersions of the invention may be silicone oils as well as antifoams based on tributylphosphate, 2-ethylhexanol or tetramethyl-5-decinediols (=Surfynol).

Preferred antifoams are alkylenediamides, preferably of formula $$V_1—CO—NH—Q—NH—CO—V_2 \quad (13)$$

wherein $V_1$ and $V_2$ are each independently of the other an aliphatic radical of 9 to 23 carbon atoms and Q is an alkylene radical of 1 to 8, preferably 1, 2 or 3, carbon atoms.

The alkylenediamide may be present as a single compound or in the form of a mixture.

The aliphatic radicals $V_1$ and $V_2$ can be straight-chain or branched. Together with the CO group they are conveniently the acid radical of an unsaturated or preferably saturated aliphatic carboxylic acid of 10 to 24 carbon atoms. Typical examples of aliphatic carboxylic acids are capric, lauric, coconut fatty, myristic, palm kernel fatty, palmitic, tallow fatty, oleic, ricinoleic, linolenic, stearic, arachic, arachidonic, behenic, erucic and lignoceric acids. Behenic acid and, in particular, stearic acid are preferred.

It is also possible to use the mixtures of these acids obtained by the cleavage of natural oils or fats. Coconut fatty acid, palm kernel fatty acid, palmitic/stearic acid mixtures, tallow fatty acid and arachic/behenic acid mixtures are particularly preferred mixtures.

Preferably $V_1$ and $V_2$ are each an alkyl radical of 9 to 23 carbon atoms, most preferably of 15 to 21 carbon atoms.

Q is preferably an alkylene group which contains 2 to 5 carbon atoms and can be straight-chain or branched. Such a group is typically the $—CH_2CH_2—$, $—CH_2CH_2CH_2—$,

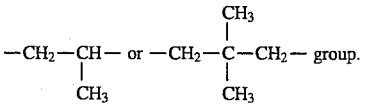

Typical representatives of alkylenediamide antifoams are methylenebis(stearamide), ethylenebis(stearamide) and ethylenebis(behenamide).

The alkylendiamide is preferably present in the dispersion in an amount of 0.2 to 3 per cent by weight.

Suitable preservatives for use in the dispersions according to the invention are a wide range of commercially available products, such as aqueous solutions of formaldehyde, 6-acetoxy-2,4-dimethyldioxane, 1,2-benzisothiazolin-3-one and, preferably, 2-chloroacetamide.

Antifreeze agents which can be added to the dispersions of the invention to preserve flowability at low temperatures and to prevent water from freezing are glycols or polyols, typically ethylene glycol, propylene glycol or glycerol, and polyethylene glycols, such as di-, tri- or tetraethylene glycol. A preferred antifreeze agent is propylene glycol.

Component (a) may also be used in the form of a mixture of the s-triazines of formula (1) with other UV absorbers of the classes of the sparingly soluble benzotriazoles and benzophenones. Such UV absorbers are disclosed in U.S. Pat. Nos. 3,004,896; 3,074,910; 4,127,586 and 4,557,730. Suitable benzotriazoles are typically those of formula (14)

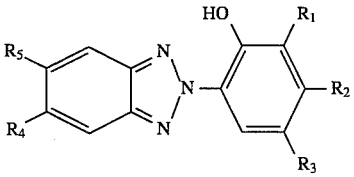

(14)

wherein $R_1$ is hydrogen, $C_1$–$C_{12}$alkyl, chloro, $C_5$–$C_6$cycloalkyl or $C_7$–$C_9$phenylalkyl, $R_2$ is hydrogen, $C_1$–$C_4$alkyl, $C_1$–$C_4$alkoxy, chloro or hydroxy, $R_3$ is $C_1$–$C_{12}$alkyl, $C_1$–$C_4$alkoxy, phenyl, ($C_1$–$C_8$alkyl)phenyl, $C_5$–$C_6$cycloalkyl, $C_2$–$C_9$alkoxycarbonyl, chloro, carboxyethyl or $C_7$–$C_9$phenylalkyl, $R_4$ is hydrogen, chloro, $C_1$–$C_4$alkyl, $C_1$–$C_4$alkoxy or $C_2$–$C_9$alkoxycarbonyl, and $R_5$ is hydrogen or chloro, and suitable benzophenones are those of formula (15)

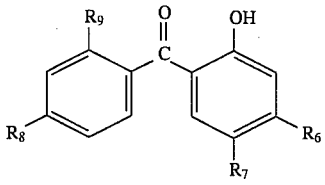

(15)

wherein $R_6$ is hydrogen, hydroxy, $C_1$–$C_{14}$alkoxy or phenoxy, $R_7$ is hydrogen, halogen or $C_1$–$C_4$alkyl, $R_8$ is hydrogen, hydroxy or $C_1$–$C_4$alkoxy, and $R_9$ is hydrogen, or hydroxy.

Such component (a) mixtures contain the compounds of formulae (1), (14) and (15) in the weight ratios of (1):(14) and (1):(15) of 99:1 to 1:99. Mixtures of the compounds of formulae (1), (14) and (15) are also suitable as component (a).

In formulae (14) and (15):

$C_1$–$C_4$alkyl is typically methyl, ethyl, propyl, isopropyl, n-butyl, sec-butyl or tert-butyl;

$C_1$–$C_4$alkoxy is typically methoxy, ethoxy, propoxy or n-butoxy;

$C_1$–$C_{14}$alkoxy is typically methoxy, ethoxy, propoxy, n-butoxy, octyloxy, dodecyloxy or tetradecyloxy;

$C_1$–$C_{12}$alkyl is typically ethyl, amyl, tert-octyl, n-dodecyl and preferably methyl, sec-butyl or tert-butyl;

$C_2$–$C_9$alkoxycarbonyl is conveniently ethoxycarbonyl, n-octyloxycarbonyl or, preferably, methoxycarbonyl;

$C_5$–$C_6$cycloalkyl is conveniently cyclopentyl or cyclohexyl;

($C_1$–$C_8$alkyl)phenyl is conveniently methylphenyl, tert-butylphenyl, tert-amylphenyl or tert-octylphenyl, and $C_7$–$C_9$phenylalkyl is conveniently benzyl, α-methylbenzyl or, preferably, α,α-dimethylbenzyl.

The aqueous dispersions of the invention advantageously comprise, in each case based on the entire dispersion,

| | |
|---|---|
| 5–50 | percent by weight of component (a), |
| 0–18 | percent by weight, preferably 0.5–15 percent by weight, of component (b), |
| 0–18 | percent by weight, preferably 0.5–15 percent by weight, of component (c), |
| 0–5 | percent by weight, preferably 0.1 to 4 percent by weight, of component (d), |
| 0–8 | percent by weight of further anionic components other than component (b), |
| 0–8 | percent by weight of further nonionic components other than component (c), |
| 0–7 | percent by weight, preferably 0.1 to 5 percent by weight, of antifoam, |
| 0–1 | percent by weight, preferably 0.1 to 0.5 percent by weight, of preservative, and |
| 0–20 | percent by weight of antifreeze agent. |

Preferred dispersions of the invention comprise as anionic component (b) a condensate of formaldehyde with an aromatic sulfonic acid;

a condensate of formaldehyde with ditolyl ether sulfonate;

a mixture of components (ba) to (bh);

a mixture of a condensate of formaldehyde with ditolyl ether sulfonate and a phosphate ester of the polyadduct of formula (6) or a salt thereof, a condensate of formaldehyde with an aromatic sulfonic acid and, as nonionic component (c), an alkylene oxide polyadduct of formula (10);

as nonionic component (c) a mixture of an alkylene oxide polyadduct of formula (10) and an alkylene oxide condensate (cc), or an alkylene oxide condensate (cc) or, as anionic component (b) a condensate of formaldehyde with an aromatic sulfonic acid and, as nonionic component (c), a polyadduct of alkylene oxide with sorbitan acid, or, as anionic component (b), a phosphate ester of the polyadduct of formula (6) or the salt thereof, and as nonionic component(c), an alkylene oxide polyadduct of formula (10).

The dispersion of the invention is conveniently prepared by making the s-triazines of formula (1) into a paste with a dispersant, for example the acid ester of formula (4), and water in a mixer and, after addition of any desired additional components, such as nonionic surfactants, further anionic and/or nonionic compounds, including the antifoam, preservative and antifreeze agent, dispersing the mixture for 1 to 30, preferably 1 to 10, hours. Dispersing is conveniently effected by the action of high shear forces, for example by milling in a ball, sand or bead mill. After milling, an aqueous solution of the stabiliser or thickener (component (d)) and, if desired, further water can be added, and the mixture is stirred until a homogeneous dispersion is obtained.

The dispersions of the invention have good stability to transportation and storage. In particular, they are very stable at high temperatures up to 130° C. when added to dyebaths.

Depending on the dye, the dispersions of the invention are used for dyeing synthetic fibres. Each dyeing process is carried out in conventional manner. The dispersion is slowly stirred into an aqueous bath, after which the liquor is ready for dyeing after addition of the dye.

Accordingly, the invention also relates to a process for dyeing synthetic fibre material with cationic or disperse dyes. The process comprises dyeing said material in the presence of the dispersion of this invention.

The amounts in which the dispersions are added to the dyebaths vary from 0.5 to 10%, preferably 1 to 5%, based on the weight of the goods.

The fibre material, in particular textile material, which can be dyed in the presence of the novel light stabiliser formulation comprises for example cellulose ester fibres, such as secondary acetate fibres and cellulose acetate fibres, aromatic polyamide fibres derived for example from poly-(metaphenyleneisophthalamide), acid-modified polyester fibres, in particular linear polyester fibres. Of these, cellulose ester and polyester fibres are preferably dyed with disperse dyes and acid-modified polyester fibres and aromatic polyamide fibres preferably with cationic dyes.

Linear polyester fibres are meant in this context synthetic fibres obtained for example by condensation of terephthalic acid with ethylene glycol or of isophthalic acid or terephthalic acid with 1,4-bis-(hydroxymethyl)cyclohexane and copolymers of terephthalic and isophthalic acid and ethylene glycol. The linear polyester hitherto used almost exclusively in the textile industry consists of terephthalic acid and ethylene glycol. Acid-modified polyester fibres are typically polycondensates of terephthalic acid or isophthalic acid, ethylene glycol and sodium 3-(1,3- or 2,3-dihydroxypropoxy)propanesulfonate, sodium (2,3-dimethylolbutoxy)propanesulfonate, disodium isopropylidenedibenzeneoxypropylsulfonate or 3,5-dicarboxybenzenesulfonic acid, sulfonated terephthalic acid, sulfonated 4-methoxybenzenecarboxylic acid or sulfonated biphenyl-4,4'-dicarboxylic acid.

The fibre materials can also be used as blends with one another or with other fibres, for example blends of polyacrylonitrile/polyester, polyamide/polyester, polyester/cotton, polyester/viscose and polyester/wool.

The textile material to be dyed can be in different forms of presentation. Examples of suitable forms are: loose material, piecegoods such as woven or knitted fabrics, yarn in cheese or muff form. The latter can have package densities of 200 to 600 g/dm$^3$, in particular 400 to 450 g/dm$^3$.

The cationic dyes suitable for the process according to the invention can belong to different classes of dyes. They are in particular the customary salts, for example chlorides, sulfates or metal halides, such as zinc chloride double salts, of cationic dyes whose cationic character derives typically from a carbonium, oxonium, sulfonium or, preferably, ammonium group. Examples of such chromophoric systems are azo dyes, preferably monoazo or hydrazone dyes, diphenylmethane, triphenylmethane, methine or azomethine dyes, coumarin, ketone-imine, cyanine, azine, xanthene, oxazine or thiazine dyes. Finally, it is also possible to use dye salts of the phthalocyanine or anthraquinone series having an external onium group, for example an alkylammonium or cycloammonium group, and also benzo-1,2-pyran dye salts which contain cycloammonium groups.

The disperse dyes to be used, which are only very sparingly soluble in water and are mostly present in the dyeing liquor in the form of a fine dispersion, can belong to a wide range of dye classes, for example the acridone, azo, anthraquinone, coumarin, methine, perinone, naphthoquinone-imine, quinophthalone, styryl or nitro dyes.

It is also possible to use mixtures of cationic or disperse dyes in the practice of this invention.

The amount of dye to be added to the liquor will depend on the desired depth of shade; suitable mounts range in general from 0.01 to 10, preferably 0.02 to 5, per cent by weight, based on the textile material used.

The assistants to be used according to the invention can also be used in admixture with known diffusion accelerators, based for example on di- or trichlorobenzene, methylbenzene, ethylbenzene, o-phenylphenol, benzylphenol, diphenyl ether, chlorobiphenyl, methylbiphenyl, cyclohexanone, acetophenone, alkylphenoxyethanol, mono-, di- or trichlorophenoxy-ethanol or -propanol, pentachlorophenoxyethanol, alkylphenyl benzoates or, in particular, based on biphenyl, methyl biphenyl ether, dibenzyl ether, methyl benzoate, butyl benzoate or phenyl benzoate.

The diffusion accelerators are preferably used in an amount of 0.5 g to 5 g/l of liquor or 5 to 30 per cent by weight, based on the assistant dispersion.

Depending on the textile material to be treated, the dyebaths may contain oligomer inhibitors, antifoams, crease-resist agents, retarders and, preferably, dispersants, as well as dyes and the assistant formulation of the invention.

The dispersants are used in particular to ensure the fine dispersion of the disperse dyes. Suitable dispersants are those customarily used for dyeing with disperse dyes.

Suitable dispersants are preferably sulfated or phosphated polyadducts of 15 to 100 mol of ethylene oxide or preferably propylene oxide with polyhydric aliphatic alcohols of 2 to 6 carbon atoms, for example ethylene glycol, glycerol or pentaerythritol, or with amines of 2 to 9 carbon atoms having at least two amino groups or an amino group and a hydroxyl group, and also alkylsulfonates of 10 to 20 carbon atoms in the alkyl chain, alkylbenzenesulfonates having a linear or branched alkyl chain of 8 to 20 carbon atoms in the alkyl chain, for example nonylbenzenesulfonate, dodecylbenzenesulfonate, 1,3,5,7-tetramethyloctylbenzenesulfonate or octadecylbenzenesulfonate, and also alkylnaphthalenesulfonates or sulfosuccinic esters, such as sodium dioctyl sulfosuccinate.

Particularly useful anionic dispersants are ligninsulfonates, polyphosphates and, preferably, condensates of formaldehyde with aromatic sulfonic acids, condensates of formaldehyde with mono- or bi-functional phenols, for example with cresol, β-naphtholsulfonic acid and formaldehyde, with benzenesulfonic acid, formaldehyde and naphthalenesulfonic acid, with naphthalenesulfonic acid and formaldehyde or with naphthalenesulfonic acid, dihydroxydiphenyl sulfone and formaldehyde. The disodium salt of di- or tri(6-sulfo-2-naphthyl)methane is preferred.

It is also possible to use mixtures of anionic dispersants. Normally, the anionic dispersants are present in the form of their alkali metal salts, ammonium salts or amine salts. These dispersants are preferably used in an amount of 0.5 to 8 g/l of liquor.

The dyebaths can also contain customary additives, preferably electrolytes such as salts, for example sodium sulfate, ammonium sulfate, sodium phosphate or polyphosphates, ammonium phosphate or polyphosphates, metal chlorides or nitrates such as calcium chloride, magnesium chloride or calcium nitrates, ammonium acetate or sodium acetate and/or acids, for example mineral acids, such as sulfuric acid or phosphoric acid, or organic acids, preferably lower aliphatic carboxylic acids such as formic, acetic or oxalic acid. The acids are used in particular to adjust the pH of the liquors to be used according to the invention, the pH normally being from 4 to 6.5, preferably 4.5 to 6.

Dyeing is conveniently carried out from an aqueous liquor by the exhaust method. The liquor ratio can accordingly be chosen within a wide range, for example 1:3 to 1:100, preferably 1:7 to 1:50. The temperature at which the dyeing or whitening takes place is at least 70° C. and is normally not higher than 140° C. Preferably the temperature is within the range from 80° to 135° C.

Linear polyester fibres and cellulose acetate fibres are preferably dyed by the high-temperature method in closed and advantageously also pressure-resistant machines at temperatures of above 100° C., preferably in the range from 110° to 135° C., and under atmospheric or superatmospheric pressure. Suitable closed vessels are typically circulation dyeing machines such as package or beam dyeing apparatus, winch becks, jet or drum dyeing machines, muff dyeing machines, paddle machines or jiggers.

Secondary acetate fibres are preferably dyed at temperatures of 80°–85° C. Aromatic polyamide fibres or acid-modified polyesters are preferably dyed in the temperature range from 80° to 130° C.

The dyeing process can be carried out either by treating the material to be dyed first briefly with the assistant formulation and then dyeing, or preferably by simultaneous treatment with the assistant formulation and the dye.

Preferably the fibre material is first run in the bath which contains the dye, the assistant formulation and any further additives, and which has been adjusted to pH 4.5–5.5, at 60°–80° C. for 5 minutes, the temperature is then raised to 110°–135° C., preferably 125°–130° C., over 15–35 minutes, and the dye liquor is kept at this temperature for 15 to 90 minutes, preferably 30 to 60 minutes.

The dyeings are finished by cooling the dye liquor to 60°–80° C., rinsing the dyeings with water and, if necessary, reduction clearing them in conventional manner in alkaline medium. The dyeings are then rinsed again and dried.

The dyeings obtained on fibre material, especially on linear polyester fibres, are level and tinctorially strong and, in addition, have good fastness to light and rubbing. During dyeing, the dye liquor remains stable and no deposits form in the interior of the dyeing apparatus.

In the following Examples parts and percentages are by weight.

EXAMPLE 1

The following components are mixed in a sand mill:

| | |
|---|---|
| 35 parts | of 2-(2'-hydroxy-4'-propoxyphenyl)-4,6-diphenyl-s-triazine |
| 14 parts | of the reaction product, neutralised with triethanolamine, of phosphorus pentoxide with the polyadduct (18 EO units) of ethylene oxide with 2.5 to 3 mol of styrene and 1 mol of phenol, and |
| 51 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide and 3.6 parts of water to give a storage stable dispersion.

EXAMPLE 2

The following components are mixed in a sand mill:

| | |
|---|---|
| 17.5 parts | of 2-(2'-hydroxy-4'-propoxyphenyl)-4,6-diphenyl-s-triazine, |
| 17.5 parts | of 2-(2'-hydroxy-3'-tert-butyl-5'-methylphenyl)-5-chlorobenzotriazole, |
| 14 parts | of the reaction product, neutralised with triethanolamine, of phosphorus pentoxide with the polyadduct (18 EO units) of ethylene oxide with 2.5 to 3 mol of styrene and 1 mol of phenol, and |
| 51 parts | of water. |

The mixture is then milled with quartz sand until the particle size is <5 μm, and the resultant dispersion is subsequently separated from the quartz sand.

71.4 parts of the resultant dispersion are homogenised by stirring with 25.0 parts of a 1% aqueous solution of a biopolymer based on polysaccharide and 3.6 parts of water to give a storage stable dispersion.

EXAMPLE 3

The following components are mixed in a sand mill:

| | |
|---|---|
| 17.5 parts | of 2-(2'-hydroxy-4'-propoxyphenyl)-4,6-diphenyl-s-triazine, |
| 17.5 parts | of 2-hydroxy-4-octyloxybenzophenone, |
| 14 parts | of the reaction product, neutralised with triethanolamine, of phosphorus pentoxide with the polyadduct (18 EO units) of ethylene oxide with 2.5 to 3 mol of styrene and 1 mol of phenol, and |
| 51 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide and 3.6 parts of water to give a storage stable dispersion.

EXAMPLE 4

The following components are mixed in a sand mill:

| | |
|---|---|
| 35.0 parts | of 2-(2'-hydroxy-4'-methoxyphenyl)-4,6-diphenyl-s-triazine, |
| 10.0 parts | of a salt-free condensate of sodium ditolyl ether |

-continued

| | |
|---|---|
| | sulfonate and formaldehyde, |
| 1.0 part | of a polyadduct of 9 mol of ethylene oxide with 1 mol of nonylphenol, |
| 1.0 part | of a polyadduct of ethylene oxide with the adduct of propylene oxide and propylene glycol, the polypropylene oxide component having an average molecular weight of ca. 2050 and containing ca. 50% of polypropylene oxide in the molecule (EO–PO block polymer), and |
| 53.0 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide and 3.6 parts of water to give a storage stable dispersion.

EXAMPLE 5

The following components are mixed in a sand mill:

| | |
|---|---|
| 35.0 parts | of 2-(2'-hydroxy-4'-methoxyphenyl)-4,6-diphenyl-s-triazine, |
| 10.0 parts | of the sodium salt of a condensate of phenol, lignin-sulfonate and formaldehyde, |
| 1.0 part | of a polyadduct of 9 mol of ethylene oxide with 1 mol of nonylphenol, |
| 1.0 part | of a polyadduct of ethylene oxide with the adduct of propylene oxide and propylene glycol, the polypropylene oxide component having an average molecular weight of ca. 2050 and containing ca. 50% of polypropylene oxide in the molecule (EO–PO block polymer), and |
| 53.0 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide and 3.6 parts of water to give a storage stable dispersion.

EXAMPLE 6

The following components are mixed in a sand mill:

| | |
|---|---|
| 35.0 parts | of 2-(2'-hydroxy-4'-methoxyphenyl)-4,6-diphenyl-s-triazine, |
| 10.0 parts | of the sodium salt of a condensate of a mixture of cresol isomers with formaldehyde, |
| 1.0 part | of a polyadduct of 9 mol of ethylene oxide with 1 mol of nonylphenol, |
| 1.0 part | of a polyadduct of ethylene oxide with the adduct of propylene oxide and propylene glycol, the polypropylene oxide component having an average molecular weight of ca. 2050 and containing ca. 50% of polypropylene oxide in the molecule (EO–PO block polymer), ad |
| 53.0 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide and 3.6 parts of water to give a storage stable dispersion.

EXAMPLE 7

The following components are mixed in a sand mill:

| | |
|---|---|
| 35.0 parts | of 2-(2'-hydroxy-4'-methoxyphenyl)-4,6-diphenyl-s-triazine, |
| 3.0 parts | of the sodium salt of a condensate of naphthalene-sulfonic acid and formaldehyde, |
| 10.0 parts | of a polyadduct of ethylene oxide with the adduct of propylene oxide and propylene glycol, the polypropylene oxide component having an average molecular weight of ca. 3250 and containing ca. 20% of polypropylene oxide in the molecule (EO–PO block polymer), and |
| 52.0 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide and 3.6 parts of water to give a storage stable dispersion.

EXAMPLE 8

The following components are mixed in a sand mill:

| | |
|---|---|
| 30.0 parts | of 2-(2'-hydroxy-4'-methoxyphenyl)-4,6-diphenyl-s-triazine, |
| 2.5 parts | of the sodium salt of a condensate of naphthalene-sulfonic acid and formaldehyde, |
| 6.0 part | of a polyadduct of 17 mol of ethylene oxide with sorbitan triolate, |
| 6.0. part | of a polyadduct of 4 mol of ethylene oxide with sorbitan monolaurate, |
| 2.5 parts | of the sodium salt of the reaction product of phosphorus pentoxide with the polyadduct of 9 mol of ethylene oxide with 1 mol of nonylphenol, and |
| 53.0 parts | of water. |

The mixture is then milled with quartz sand until the particle size is <5 μm, and the resultant dispersion is subsequently separated from the quartz sand.

83.3 parts of the resultant dispersion are homogenised by stirring with 12.5 parts of a 2% aqueous solution of a biopolymer based on polysaccharide and 4.2 parts of water to give a storage stable dispersion.

EXAMPLE 9

The following components are mixed in a sand mill:

| | |
|---|---|
| 35 parts | of 2-(2'-hydroxy-4'-methoxyphenyl)-4,6-diphenyl-s-triazine |
| 14 parts | of the reaction product, neutralised with triethanol-amine, of phosphorus pentoxide with the polyadduct (18 EO units) of ethylene oxide with 2.5 to 3 mol of styrene and 1 mol of phenol, and |
| 51 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide and 3.6 parts of water to give a storage stable dispersion.

EXAMPLE 10

The following components are mixed in a sand mill:

| | |
|---|---|
| 17.5 parts | of 2-(2'-hydroxy-4'-methoxyphenyl)-4,6-diphenyl-s-triazine, |
| 17.5 parts | of 2-(2'-hydroxy-3'-tert-butyl-5'-methylphenyl)-5-chlorobenzotriazole, |
| 14 parts | of the reaction product, neutralised with triethanolamine, of phosphorus pentoxide with the polyadduct (18 EO units) of ethylene oxide with 2.5 to 3 mol of styrene and 1 mol of phenol, and |
| 51 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide and 3.6 parts of water to give a storage stable dispersion.

EXAMPLE 11

The following components are mixed in a sand mill:

| | |
|---|---|
| 17.5 parts | of 2-(2'-hydroxy-4'-methoxyphenyl)-4,6-diphenyl-s-triazine, |
| 17.5 parts | of 2-hydroxy-4-octyloxybenzophenone, |
| 14 parts | of the reaction product, neutralised with triethanolamine, of phosphorus pentoxide with the polyadduct (18 EO units) of ethylene oxide with 2.5 to 3 mol of styrene and 1 mol of phenol, and |
| 51 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide and 3.6 parts of water to give a storage stable dispersion.

EXAMPLES 12–21

The procedure described in Examples 1 to 7 and 9 to 11 is repeated, and in each Examples the resultant dispersion is homogenised by stirring with 25.0 parts a 1% aqueous solution of a biopolymer based on polysaccharide and 3.3 parts of water and 0.3 part of chloroacetamide. The dispersions so obtained are storage stable.

EXAMPLE 22

The following components are mixed in a sand mill:

| | |
|---|---|
| 30.0 parts | of 2-(2'-hydroxy-4'-methoxyphenyl)-4,6-diphenyl-s-triazine, |
| 2.5 parts | of the sodium salt of a condensate of naphthalenesulfonic acid and formaldehyde, |
| 6.0 part | of a polyadduct of 17 mol of ethylene oxide with sorbitan trioleate, |
| 6.0 part | of a polyadduct of 4 mol of ethylene oxide with sorbitan monolaurate, |
| 2.5 parts | of the sodium salt of the reaction product of phosphorus pentoxide with the polyadduct of 9 mol of ethylene oxide with 1 mol of nonylphenol, and |
| 53.0 parts | of water. |

The mixture is then milled with quartz sand until the particle size is <5 μm, and the resultant dispersion is subsequently separated from the quartz sand.

83.3 parts of the resultant dispersion are homogenised by stirring with 12.5 parts of a 2% aqueous solution of a biopolymer based on polysaccharide, 3.9 parts of water and 0.3 part of chloroacetamide to give a storage stable dispersion.

EXAMPLE 23

The following components are mixed in a sand mill:

| | |
|---|---|
| 35 parts | of 2-(2'-hydroxy-4'-propoxyphenyl)-4,6-diphenyl-s-triazine, |
| 14 parts | of the reaction product, neutralised with triethanolamine, of phosphorus pentoxide with the polyadduct (18 EO units) of ethylene oxide with 2.5 to 3 mol of styrene and 1 mol of phenol, |
| 2.8 parts | of N'-ethylenebis(stearamide) and |
| 48.2 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide, 3.3 parts of water and 0.3 part of chloroacetamide to give a storage stable dispersion.

EXAMPLE 24

The following components are mixed in a sand mill:

| | |
|---|---|
| 17.5 parts | of 2-(2'-hydroxy-4'-propoxyphenyl)-4,6-diphenyl-s-triazine, |
| 17.5 parts | of 2-(2'-hydroxy-3'-tert-butyl-5'-methylphenyl)-5-chlorobenzotriazole, |
| 14 parts | of the reaction product, neutralised with triethanolamine, of phosphorus pentoxide with the polyadduct (18 EO units) of ethylene oxide with 2.5 to 3 mol of styrene and 1 mol of phenol, |
| 2.8 parts | of N,N'-ethylenebis(stearamide), and |
| 48.2 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide, 3.3 parts of water and 0.3 part of chloroacetamide to give a storage stable dispersion.

EXAMPLE 25

The following components are mixed in a sand mill:

| | |
|---|---|
| 35 parts | of 2-(2'-hydroxy-4'-methoxyphenyl)-4,6-diphenyl-s-triazine, |
| 14 parts | of the reaction product, neutralised with triethanolamine, of phosphorus pentoxide with the polyadduct (18 EO units) of ethylene oxide with 2.5 to 3 mol of styrene and 1 mol of phenol, |
| 2.8 parts | of N,N'-ethylenebis(stearamide), and |
| 48.2 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide, 3.3 parts of water and 0.3 part of chloroacetamide to give a storage stable dispersion.

EXAMPLE 26

The following components are mixed in a sand mill:

| | |
|---|---|
| 17.5 parts | of 2-(2'-hydroxy-4'-methoxyphenyl)-4,6-diphenyl-s-triazine, |
| 17.5 parts | of 2-(2'-hydroxy-3'-tert-butyl-5'-methylphenyl)-5-chlorobenzotriazole, |
| 14 parts | of the reaction product, neutralised with triethanolamine, of phosphorus pentoxide with the polyadduct (18 EO units) of ethylene oxide with 2.5 to 3 mol of styrene and 1 mol of phenol, |
| 2.8 parts | of N,N'-ethylenebis(stearamide), and |
| 48.2 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide, 3.3 parts of water and 0.3 part of chloroacetamide to give a storage stable dispersion.

EXAMPLE 27

The following components are mixed in a sand mill:

| | |
|---|---|
| 17.5 parts | of 2-(2'-hydroxy-4'-methoxyphenyl)-4,6-diphenyl-s-triazine |
| 17.5 parts | of 2-hydroxy-4-octyloxybenzophenone, |
| 10.0 parts | of a salt-free condensate of ditolyl ether sulfonate and formaldehyde, and |
| 55.0 parts | of water. |

The mixture is then milled with quartz sand until the particle size is <5 μm, and the resultant dispersion is subsequently separated from the quartz sand.

71.4 parts of the resultant dispersion are homogenised by stirring with 25 parts of a 1% aqueous solution of a biopolymer based on polysaccharide, 3.3 parts of water and 0.3 part of chloroacetamide to give a storage stable dispersion.

EXAMPLE 28

The following components are mixed in a sand mill:

| | |
|---|---|
| 35.0 parts | of 2-(2'-hydroxy-4'-methoxyphenyl)-4,6-diphenyl-s-triazine |
| 9.1 parts | of a salt-free condensate of ditolyl ether sulfonate and formaldehyde, |
| 2.1 parts | of the reaction product, neutralised with triethanolamine, of phosphorus pentoxide with the polyadduct (18 EO units) of ethylene oxide with 2.5 to 3 mol of styrene and 1 mol of phenol, |
| 2.8 parts | of N,N'-ethylenebis(stearamide), and |
| 51.0 parts | of water. |

The mixture is then milled with quartz sand until the particle size is <5 μm, and the resultant dispersion is subsequently separated from the quartz sand.

71.4 parts of the resultant dispersion are homogenised by stirring with 20.0 parts of a 2% aqueous solution of a biopolymer based on polysaccharide, 0.3 part of chloroacetamide and 8.3 parts of water to give a storage stable dispersion.

EXAMPLE 29

The following ingredients are mixed in a sand mill:

| | |
|---|---|
| 35.0 parts | of 2-(2'-hydroxy-4'-methoxyphenyl)-4,6-diphenyl-s-triazine, |
| 10.0 parts | of a condensate of a $C_{16}$–$C_{18}$ fatty alcohol with 25 mol of ethylene oxide, and |
| 55.0 parts | of water. |

The mixture is then milled with quartz sand until the particle size is <5 μm, and the resultant dispersion is subsequently separated from the quartz sand.

71.4 parts of the resultant dispersion are homogenised by stirring with 25.0 parts of a 2% aqueous solution of a biopolymer based on polysaccharide, 0.3 part of chloroacetamide and 3.3 parts of water to give a storage stable dispersion.

EXAMPLE 30

The following ingredients are mixed in a sand mill:

| | |
|---|---|
| 35.0 parts | of 2-(2'-hydroxy-4'-methoxyphenyl)-4,6-diphenyl-s-triazine, |
| 12.5 parts | of a polyadduct (18 mol EO units) of ethylene oxide with 2.5 to 3 mol of styrene and 1 mol of phenol, and |
| 53.0 parts | of water. |

The mixture is then milled with quartz sand until the particle size is <5 μm, and the resultant dispersion is subsequently separated from the quartz sand.

71.4 parts of the resultant dispersion are homogenised by stirring with 25.0 parts of a 2% aqueous solution of a biopolymer based on polysaccharide, 0.3 part of chloroacetamide and 3.3 parts of water to give a storage stable dispersion.

EXAMPLE 31

The following ingredients are mixed in a sand mill:

| | |
|---|---|
| 35.0 parts | of 2-(2'-hydroxy-4'-methoxyphenyl)-4,6-diphenyl-s-triazine, |
| 21.0 parts | of a 33% aqueous solution of the sodium salt of the sulfated polyadduct of nonylphenol and 20 mol of ethylene oxide, and |
| 44.0 parts | of water. |

The mixture is then milled with quartz sand until the particle size is <5 μm, and the resultant dispersion is subsequently separated from the quartz sand.

71.4 parts of the resultant dispersion are homogenised by stirring with 25.0 parts of a 2% aqueous solution of a biopolymer based on polysaccharide, 0.3 part of chloroacetamide and 3.3 parts of water to give a storage stable dispersion.

EXAMPLE 32

100 g of polyester knitted fabric (polyethylene glycol terephthalate) are put at 60° C. into an HT circulation dyeing machine containing 3 liters of an aqueous liquor comprising 9 g of ammonium sulfate 18 g of the disodium salt of bis(6-sulfonaphth-2-yl)methane 5 g of a finely dispersed dye of formula

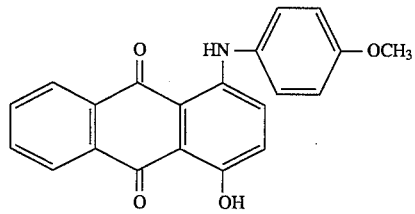

(101)

and 3 g of the assistant formulation obtained according to Example 1. The pH of the liquor has been adjusted to 5 with 85% formic acid. With constant circulation of the liquor, the dyebath is heated over 30 minutes to 130° C. and dyeing is carried out for 1 hour at this temperature. The dyebath is then cooled and the substrate is rinsed and given a reductive afterclear to remove unfixed dye. The substrate is then neutralised, rinsed once more and dried. Owing to the concurrent use of the stable assistant formulation, neither a rise in the differential pressure nor deposits in the interior of the wound package are observed during the dyeing process. A level, lightfast navy blue dyeing is obtained.

Level, lightfast navy blue dyeings are also obtained by using in place of the assistant formulation of Example 1 the assistant formulations prepared according to Examples 2 to 8.

EXAMPLE 33

100 g of a Dacron 64 fabric (acid-modified polyester) are put into an HT dyeing apparatus containing 2 liters of an aqueous liquor comprising 2 g of an amphoteric sulfated fatty amine polyethylene glycol ether, 12 g of calc. sodium sulfate, 1.5 g of a dye salt of formula

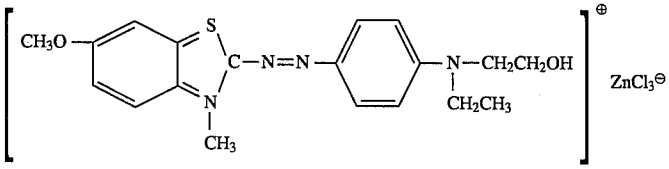

(102)

and 3 g of the aqueous assistant formulation prepared according to Example 2. The pH of the liquor has been adjusted to 4.5 with acetic acid. The dyebath is heated over 30 minutes to 120° C. and dyeing is carried out for 1 hour at this temperature. The dyebath is then cooled to 70° C., and the substrate is neutralised, rinsed and dried in conventional manner.

No precipitations and deposits are observed in the dyebath during dyeing. A level, lightfast red dyeing is obtained.

Level, lightfast red dyeings are also obtained by using in place of the assistant formulation of Example 2 the assistant formulations prepared according to Examples 1 or 3 to 8.

EXAMPLE 34

100 g of a polyester knitted fabric (polyethylene glycol terephthalate) are put into an HT circulation dyeing maching containing 3 liters of an aqueous liquor comprising 9 g of ammonium sulfate 18 g of the disodium salt of bis(6-sulfonaphth-2-yl)methane 5 g of a finely dispersed dye of formula

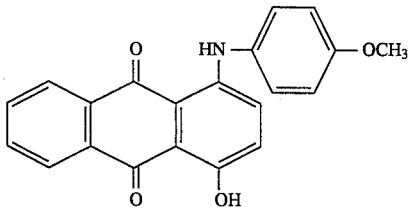

(101)

and 3 g of the assistant formulation obtained according to Example 9. The pH of the liquor has been adjusted to 5 with 85% formic acid. With constant circulation of the liquor, the dyebath is heated over 30 minutes to 130° C. and dyeing is carried out for 1 hour at this temperature. The dyebath is then cooled and the substrate is rinsed and given a reductive afterclear to remove unfixed dye. The substrate is then neutralised, rinsed once more and dried. Owing to the concurrent use of the stable assistant formulation, neither a rise in the differential pressure nor deposits in the interior of the wound package are observed during the dyeing process. A level, lightfast navy blue dyeing is obtained.

Level, lightfast navy blue dyeings are also obtained by using in place of the assistant formulation of Example 9 the assistant formulations prepared according to Examples 10 and 11.

EXAMPLE 35

100 g of Dacron 64 fabric (acid-modified polyester) are put into an HT dyeing apparatus containing 2 liters of an aqueous liquor comprising 2 g of an amphoteric sulfated fatty amine polyethylene glycol ether, 12 g of calc. sodium sulfate, 1.5 g of a dye salt of formula

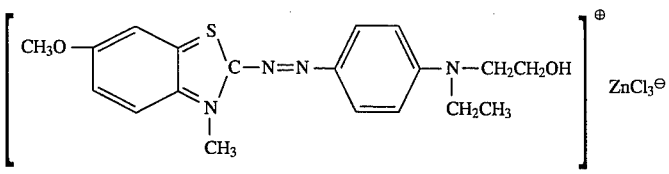

(102)

and 3 g of the aqueous assistant formulation prepared according to Example 10. The pH of the liquor has been adjusted to 4.5 with acetic acid. The dyebath is heated over 30 minutes to 120° C. and dyeing is carried out for 1 hour at this temperature. The dyebath is then cooled to 70° C., and the substrate is neutralised, rinsed and dried in conventional manner.

No precipitations and deposits are observed in the dyebath during dyeing. A level, lightfast red dyeing is obtained.

Level, lightfast red dyeings are also obtained by using in place of the assistant formulation of Example 10 the assistant formulations prepared according to Examples 9 or 11.

We claim:

1. An aqueous dispersion of a 2-(2'-hydroxyphenyl)-s-triazine comprising (a) 5 to 50 percent by weight of an s-triazine compound of the formula

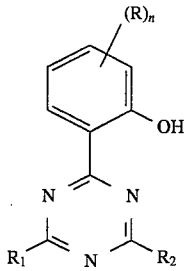

(1)

wherein

R is lower alkyl, lower alkoxy, halogen or hydroxy, $R_1$ and $R_2$ are each independently of the other $C_1$–$C_{18}$alkyl, $C_1$–$C_{18}$alkyl which is substituted by hydroxy, lower alkoxy, lower alkylthio, amino or mono- or dialkylamino, phenyl or phenyl which is substituted by chloro, hydroxy, lower alkyl and/or lower alkoxy, and n is 0, 1 or 2, (b) 0 to 18 percent by weight of an anionic compound or mixture of anionic compounds selected from the group consisting of acid esters, or their salts, of alkylene oxide polyadducts of the formula

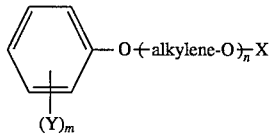

(4)

wherein

X is the acid radical of an inorganic oxygen-containing acid or the radical of an organic acid, and Y is $C_4$–$C_{12}$alkyl, benzyl or α-methylbenzyl, alkylene is the ethylene or propylene radical, and m is 1 to 4 and n is 4 to 50, acid esters, or their salts, of alkylene oxide polyadducts of the formula

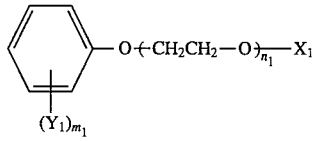

(5)

wherein $Y_1$ is phenyl, tolyl, tolyl-$C_1$–$C_3$alkyl or phenyl-$C_1$–$C_3$alkyl, $X_1$ is an acid radical which is derived from sulfuric acid or o-phosphoric acid, and $m_1$ is 1 to 3 and $n_1$ is 4 to 40, phosphate esters, or the salts thereof, of a polyadduct of 6 to 30 moles of ethylene oxide with 1 mole of 4-nonylphenol or dinonylphenol, or with 1 mole of a compound which is prepared by addition of 1 to 3 moles of styrene, α-methylstyrene or vinyl toluene to 1 mole of phenol, cresol or xylenol, and phosphate esters, or the salts thereof, of the polyadduct of the formula

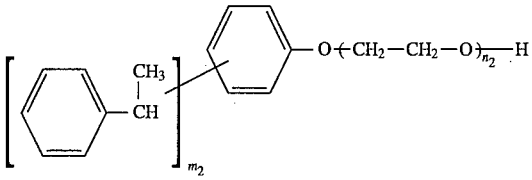

(6)

wherein $m_2$ is 1 to 3 and $n_2$ is 8 to 30, and (c) 0 to 18 percent by weight of a nonionic compound or mixture of nonionic compounds selected from the group consisting of (ca) alkylene oxide polyadducts of the formula

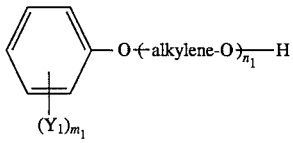

(10)

wherein $Y_1$ is $C_1$–$C_{12}$alkyl, aryl or aralkyl, alkylene denotes the ethylene radical or propylene radical and $m_1$ is 1 to 4 and $n_1$ is 4 to 50, (cb) polyadducts of alkylene oxides with (cba) saturated or unsaturated monohydric to hexahydric aliphatic alcohols, (cbb) fatty acids, (cbc) fatty amines, (cbd) fatty amides, (cbe) diamines, or (cbf) sorbitan esters, (cc) alkylene oxide condensates (block polymers), (cd) polymers of vinyl pyrrolidone, vinyl acetate or vinyl alcohol, and (ce) copolymers or terpolymers of vinyl pyrrolidone with vinyl acetate and/or vinyl alcohol, with the proviso that at least one of components (b) and (c) is present in the dispersion.

2. A dispersion according to claim 1, which additionally comprises 0.5 to 10% of an aqueous solution or dispersion of a polymerised ethylenically unsaturated mono- or dicarboxylic acid of 3 to 5 carbon atoms as component (d).

3. A dispersion according to claim 1, which additionally comprises an antifoam of the formula

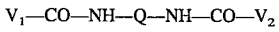

$$V_1—CO—NH—Q—NH—CO—V_2 \quad (13)$$

wherein $V_1$ and $V_2$ are each independently of the other an aliphatic radical of 9 to 23 carbon atoms and Q is an alkylene radical of 1 to 8 carbon atoms.

4. A dispersion according to claim 1, which additionally comprises a preservative and/or an antifreeze agent.

* * * * *